US005272046A

United States Patent [19]

Sasaoka

[11] Patent Number: 5,272,046

[45] Date of Patent: Dec. 21, 1993

[54] PROCESSING METHOD FOR A SILVER HALIDE PHOTOGRAPHIC MATERIAL

[75] Inventor: Senzo Sasaoka, Kanagawa, Japan

[73] Assignee: Fuji Photo Film Co., Ltd., Kanagawa, Japan

[21] Appl. No.: 787,323

[22] Filed: Oct. 24, 1991

[30] Foreign Application Priority Data

Oct. 25, 1990 [JP] Japan ..... 2-287602

[51] Int. Cl.[5] ..... G03C 5/38

[52] U.S. Cl. ..... 430/453; 430/264; 430/455; 430/963

[58] Field of Search ..... 430/363, 393, 419, 453, 430/455, 456, 464, 963, 966, 967, 264

[56] References Cited

U.S. PATENT DOCUMENTS 5,028,516 7/1991 Mukunoki et al. ..... 430/963
5,028,520 7/1991 Ito ..... 430/966
5,030,546 7/1991 Takamuki et al. ..... 430/963
5,066,569 11/1991 Nagashima et al. ..... 430/963
5,079,134 1/1992 Toya ..... 430/966
5,098,818 3/1992 Ito et al. ..... 430/963

FOREIGN PATENT DOCUMENTS 2269137 11/1988 Japan ..... 430/966
1302248 12/1989 Japan ..... 430/966

*Primary Examiner*—Hoa Van Le
*Attorney, Agent, or Firm*—Sughrue, Mion, Zinn, Macpeak & Seas

[57] ABSTRACT

There is disclosed a method for rapidly processing a silver halide photographic material with an automatic processing machine for 20 to 60 seconds, the method being excellent fixability and drying characteristics. The fixing solution has:

(a) a pH of 5.3 or more, (b) a sulfite ion concentration of 0.05 to 1.0 mole/liter, and (c) a content of an aluminium compound content of 0 to 0.01 mole/liter as a hardener. The coated amount of the gelatin contained in the protective layer provided on the side of the silver halide emulsion layers of the photographic material is 1.0 g/m$^2$ or less.

9 Claims, No Drawings

PROCESSING METHOD FOR A SILVER HALIDE PHOTOGRAPHIC MATERIAL

FIELD OF THE INVENTION

The present invention relates to a processing method for a silver halide photographic material, and in particular to a processing method with an improved fixing property, drying property and an excellent rapid processing property.

BACKGROUND OF THE INVENTION

To keeping step with the advances in the electronics field, rapidness is required in a silver halide photographic field. Especially with a sheet light-sensitive material such as a graphic arts light-sensitive material, a light-sensitive material for scanning and an X-ray light-sensitive material, a rapid processing has become more and more necessary. Rapid processing is defined by the total processing time of 20 to 60 seconds from time which the head of a photographic film is inserted into an automatic processor until the time it comes out from a drying unit, having passed through developing, fixing, washing and drying units. Acceleration of transporting speed in an automatic processor for shortening the processing time results in various problems such as deterioration of fixing and drying properties and reduction of Dmax.

It is known that the concentration of thiosulfates may be increased in order to accelerate fixing speed. Further, it is also known and widely practiced to added a water-soluble aluminium compound to a fixing solution in order to harden a layer and improve the drying characteristic. However, the hardening action of the aluminium compounds in turn retards the fixing speed and therefore, it is difficult to make the drying characteristic compatible with the fixing characteristic. Further, such problems exist as smelling of acetic acid and $SO_2$ gas and the likelihood to corrode the automatic processor because the pH value of the fixing solution has to be kept at a lower level in order to stabilize the aluminium compounds in the fixing solution.

Under such circumstances, there is demanded a processing method in which the fixing speed as well as the drying speed can be accelerated in the rapid processing system.

SUMMARY OF THE INVENTION

One object of the present invention is to provide a rapid processing method for a silver halide light-sensitive material, in which the fixing and drying speeds are rapid.

These and objects of the present invention have been achieved by a method for processing a silver halide photographic material comprising a support having provided thereon at least one silver halide light-sensitive layer in the total processing time of 20 to 60 seconds with an automatic processor, wherein the automatic processor has a fixing solution which has:

(a) a pH of 5.3 or more, (b) a sulfite ion concentration of 0.05 to 1.0 mole/-liter, and (c) an aluminium compound content of 0 to 0.01 mole/liter as a hardener; and wherein a protective layer is provided on the side of the silver halide emulsion layers on the light-sensitive material and contains gelatin in an amount of 1.0 g/m$^2$ or less.

DETAILED DESCRIPTION OF THE INVENTION

In the present invention, it is possible to prepare a fixing solution which is free from the corrosion odor problems intrinsic in the fixing solution since a water-soluble aluminium salt is not contained at all or contained only to a limited extent. Therefore, the pH can be set at a level of 5.3 or more.

Thus, the reduction of the amount of the water-soluble aluminium salt contained in the fixing solution as a hardener has resulted in an increase in the fixing speed. On the other hand, it adversely affects the increase in the drying speed and therefore, the reduction of the amount of the water-soluble aluminium salt has scarcely been tried so far.

As a result of extensive investigations by the present inventors regarding the method for making the drying characteristic compatible with the fixing characteristic in the rapid processing in which a fixing solution containing no or only a little water-soluble aluminium salt is used, it has been found that the drying characteristic is compatible with the fixing characteristic when the gelatin amount of a protective layer on the side of the emulsion layers of the photographic material is 1.0 g/m$^2$ or less. Further, it has been found that the ratio of a coated silver amount (g/m$^2$)/a swelling thickness ($\mu$m) falls preferably within the range of 0.6 to 1.5, wherein the swelling thickness is defined by the value obtained by subtracting the dry thickness of the coated layers on the emulsion layers side of the photographic material from the wet thickness of the coated layers swollen in water at 25° C. A ratio smaller than 0.6 causes inferior drying and a ratio larger than 1.5 causes bad fixing.

The coated amount of gelatin in the protective layer is preferably 0.2 to 0.8 g/m$^2$, more preferably 0.3 to 0.7 g/m$^2$. The coated silver amount is preferably 2.0 to 4.0 g/m$^2$; the swelling thickness is preferably 1.5 to 6.5$\mu$; and the ratio of the coated silver amount/the swelling thickness is preferably 0.7 to 1.3.

The reduction of the coated gelatin amount in the protective layer is likely to cause pressure sensitization due to scratching or folding while improving the fixing speed and the drying speed. That is, the photographic material with the protective layer containing the low gelatin amount is likely to be sensitized due to pressure on being scratched and folded, which causes fog (herinafter referred to as pressure fog) on the obtained image. The pressure sensitization has been improved by including the compound of the following formula (I) in the material:

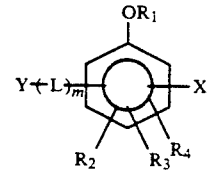

(I)

wherein X represents $OR_1$ or

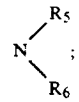

;

$R_1$ represents a hydrogen atom or a group capable of becoming a hydrogen atom by hydrolysis; $R_2$, $R_3$ and $R_4$ each represent a hydrogen atom or a substituent; $R_5$ and $R_6$ each represent a hydrogen atom, an alkyl group, an aryl group, an alkylsulfonyl group, an arylsulfonyl group, an alkylcarbonyl group, an arylcarbonyl group, or a carbamoyl group; Y represents a group promoting absorption to silver halide; L represents a divalent linkage group; and m is 0 or 1.

In the above formula, the group represented by $R_1$ and capable of becoming a hydrogen atom by hydrolysis is, for example, $—COR_7$ in which $R_7$ represents a substituted or unsubstituted alkyl group (preferably having 1 to 20 carbon atoms), a substituted or unsubstituted aryl group (preferably having 6 to 20 carbon atoms), a substituted or unsubstituted amino group (preferably having 0 to 20 carbon atoms), or

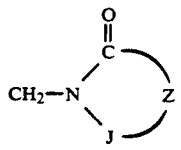

in which J represents

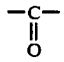

or $—SO_2—$, and Z represents the atoms necessary to form a heterocyclic ring having at least one 5- or 6-membered ring.

The groups $R_2$, $R_3$ and $R_4$ may be substituted by a halogen atom (e.g. fluorine, chlorine and bromine), an alkyl group (having preferably 1 to 20 carbon atoms), an aryl group (having preferably 6 to 20 carbon atoms), an alkoxy group (having preferably 1 to 20 carbon atoms), an aryloxy group (having preferably 6 to 20 carbon atoms), an alkylthio group (having preferably 1 to 20 carbon atoms), an arylthio group (having preferably 6 to 20 carbon atoms), an acyl group (having preferably 2 to 20 carbon atoms), an acylamino group (preferably an alkanoylamino group having 1 to 20 carbon atoms, or a benzoylamino group having 6 to 20 carbon atoms), a nitro group, a cyano group, an oxycarbonyl group (preferably an alkoxycarbonyl group having 1 to 20 carbon atoms, or an aryloxycarbonyl group having 6 to 20 carbon atoms), a carboxy group, a sulfo group, a ureido group (preferably an alkylureido group having 1 to 20 carbon atoms, or an arylureido group having 6 to 20 carbon atoms), a sulfonamide group (preferably an alkylsulfonamide group having 1 to 20 carbon atoms, or an arylsulfonamide group having 6 to 20 carbon atoms), a sulfamoyl group (preferably an alkylsulfamoyl group having 1 to 20 carbon atoms, or an arylsulfamoyl group having 6 to 20 carbon atoms), a carbamoyl group (preferably an alkylcarbamoyl group having 1 to 20 carbon atoms or an arylcarbamoyl group having 6 to 20 carbon atoms), an acyloxy group (having preferably 1 to 20 carbon atoms), an amino group (an unsubstituted amino group, preferably a secondary or tertiary amino group substituted with an alkyl group having 1 to 20 carbon atoms or an aryl group having 6 to 20 carbon atoms), a carbonic ester group (an alkylcarbonic ester group having 1 to 20 carbon atoms or an arylcarbonic ester group having 6 to 20 carbon atoms), a sulfonyl group (preferably an alkylsulfonyl group having 1 to 20 carbon atoms or an arylsulfonyl group having 6 to 20 carbon atoms), a sulfinyl group (preferably an alkylsulfinyl group having 1 to 20 carbon atoms or an arylsulfinyl group having 6 to 20 carbon atoms), a hydroxy group, or $$\leftarrow L \rightarrow_m Y$$

(wherein L, Y and m are as defined above).

$R_2$, $R_3$ and $R_4$ may be the same or different. Further, where two of $R_2$, $R_3$ and $R_4$ are attached to the carbon atoms adjacent to each other on the benzene ring, they may be combined to form a 5- to 7-membered carbon ring or heterocyclic ring which may be saturated or unsaturated.

Examples of that ring-forming compound include cyclopentane, cyclohexane, cycloheptane, cyclopentene, cyclohexadiene, cycloheptadiene, indane, norbornane, norbornene, and pyridine, and they may be substituted.

The total number of carbon atoms contained in each of $R_2$, $R_3$ and $R_4$ is preferably 1 to 10.

$R_5$ and $R_6$ each represent a hydrogen atom; a substituted or unsubstituted alkyl group (preferably having 1 to 20 carbon atoms), a substituted or unsubstituted aryl group (preferably having 6 to 20 carbon atoms), a substituted or unsubstituted alkylsulfonyl group (preferably having 1 to 20 carbon atoms), a substituted or unsubstituted arylsulfonyl group (preferably having 6 to 20 carbon atoms), a substituted or unsubstituted alkylcarbonyl group (preferably having 1 to 20 carbon atoms), a substituted or unsubstituted arylcarbonyl group (preferably having 6 to 20 carbon atoms), and a substituted or unsubstituted carbamoyl group (preferably having 1 to 20 carbon atoms). $R_5$ and $R_6$ may be the same or different and may be combined to form a nitrogen-containing hetero ring (e.g., a morpholino group, a piperidino group, a pyrrolidino group, an imidazolyl group, and a piperadino group).

The substituents to the $R_5$ and $R_6$ groups are the same as those defined for $R_2$, $R_3$ and $R_4$. $R_5$ and $R_6$ are preferably hydrogen atoms.

X is disposed preferably at an ortho or paraposition to the $—OR_1$ group. X is preferably a $—OR_1$ group, and $R_1$ is preferably a hydrogen atom.

Y is a group promoting adsorption to silver halide and L is a divalent linkage group. m is 0 or 1. The preferable examples of the adsorption-promoting group to silver halide represented by Y are a thioamide group, a mercapto group, a group having a disulfide bond, and a 5- or 6-membered nitrogen-containing hetero ring.

The adsorption-promoting thioamide group represented by Y is a divalent group having a —CS—NH— portion and may be a part of a ring structure, or a non-cyclic thioamide group. Suitable adsorption-promoting thioamide groups can be selected from those disclosed in, for example, U.S. Pat. Nos. 4,030,925, 4,031,127, 4,080,207, 4,245,037, 4,255,511, 4,266,013, and 4,276,364, and *Research Disclosure* Vol. 151, No. 15162 (November, 1976) and Vol. 176, No. 17626 (December, 1978).

Examples of the non-cyclic thioamide group include a thioureido group, a thiourethane group, and a dithiocarbamic acid ester group. Examples of the cyclic thioamide group include 4-thiazoline-2-thione, 4-imidazoline-2-thione, 2-thiohydatoin, rhodanine, a thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzothiazoline-2-thione, each of which may be substituted.

Examples of the mercapto group represented by Y include an aliphatic mercapto group, an aromatic mercapto group, and a heterocyclic mercapto group (when a nitrogen atom is present next to a carbon atom to which a —SH group is attached, this group means a heterocyclic thioamide group which is a tautoisomer thereof, and the examples of this group are the same as those exemplified above).

Examples of the 5 or 6-membered nitrogen-containing heterocyclic group represented by Y are the 5- or 6-membered nitrogen-containing heterocyclic group consisting of the combination of nitrogen, oxygen, sulfur and/or carbon atoms. Among them, preferred are benzotriazole, triazole, tetrazole, indazole, benzimidazole, imidazole, benzothiazole, thiazole, benzoxazole, oxazole, thiadiazole, oxadiazole, and triazine. Further, they may be substituted with suitable substituents. Examples of the substituents are the same as those defined for the $R_2$, $R_3$ and $R_4$ groups.

Of the groups represented by Y, preferred are a cyclic thioamide group (i.e. a mercapto-substituted nitrogen-containing hetero ring such as 2-mercaptothiadiazole group, a 3-mercapto-1,2,4-triazole group, a 5-mercaptotetrazole group, 2-mercapto-1,3,4-oxadiazole group, and 2-mercaptobenzoxazole group), or a nitrogen-containing heterocyclic group (e.g. a bezotriazole group, a benzimidazole group, and an indazole group).

The $$Y\text{-}(L)_m$$

group may have more than two substituents which may be the same or different.

The divalent linkage group represented by L is an atom selected from C, N, S and O, or an atomic group comprising the combination of C, N, S and/or O atoms. Examples thereof include an alkylene group, an alkenylene group, an alkynylene group, an arylene group, —O—, —S—, —NH—, —N=, —CO—, —$SO_2$—, and the combinations thereof, each of which may have a substituent.

Examples of L are shown below:

—CONH—, —NHCONH—, —$SO_2$NH—, —COO—,

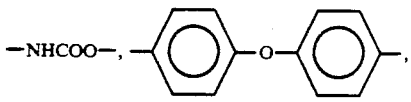

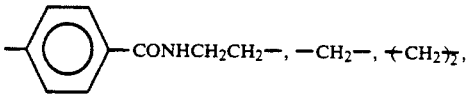

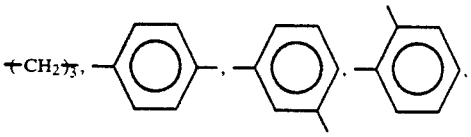

-continued

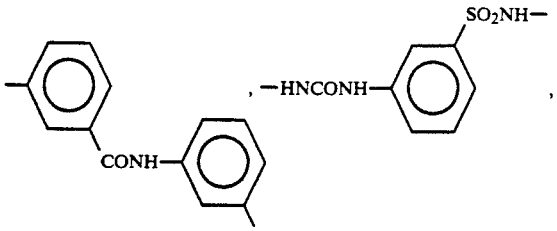

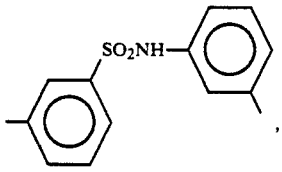

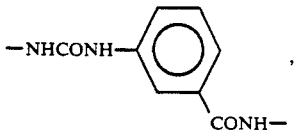

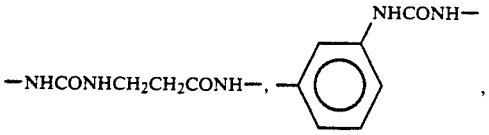

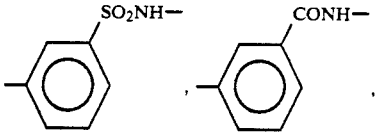

—$CH_2CH_2SO_2NH$—, —$CH_2CH_2CONH$—

The above groups are allowed to have suitable substituents. Examples thereof are the same groups as those disclosed for $R_2$, $R_3$ and $R_4$.

Next, the preferred examples of the compounds represented by formula (I) are shown below but are not limited thereto:

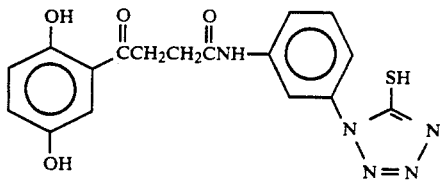

I-1)

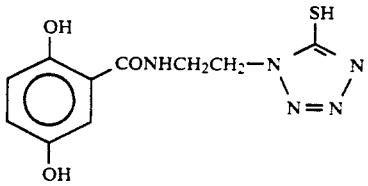

I-2)

-continued
I-3)
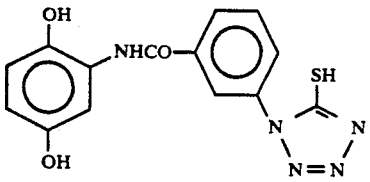
I-4)
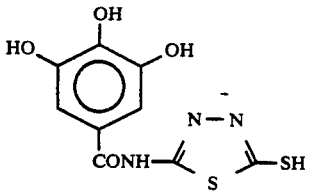
I-5)
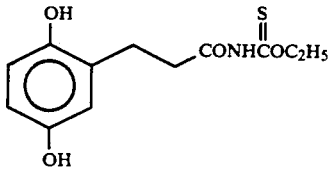
I-6)
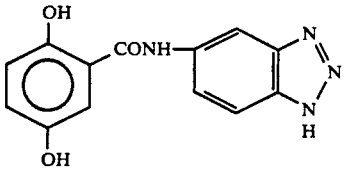
I-7)
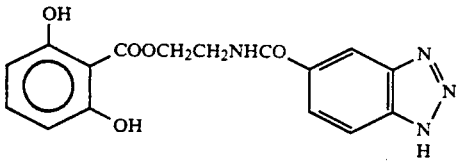
I-8)
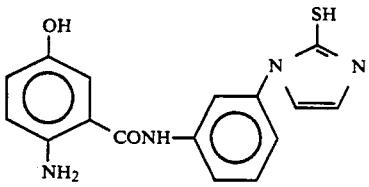
I-9)
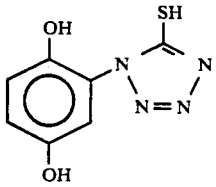
I-10)
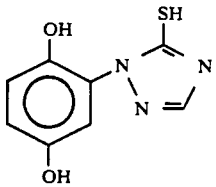
-continued
I-11)
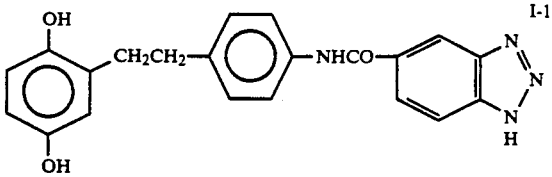
I-12)
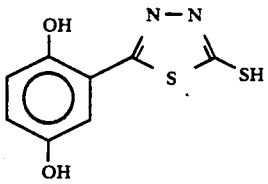
I-13)
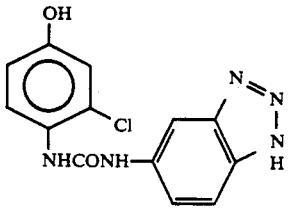
I-14)
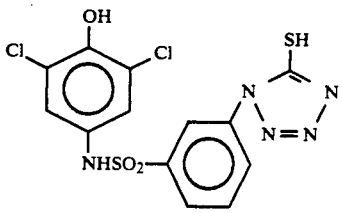
I-15)
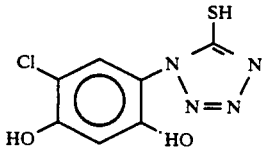
I-16)
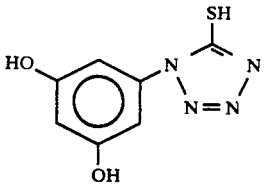
I-17)
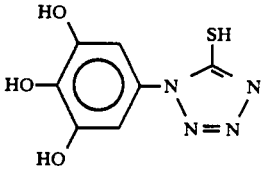
I-18)
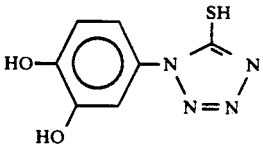

-continued

I-19)

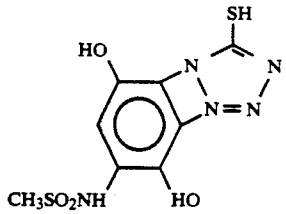

I-20)

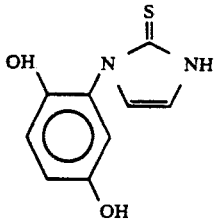

I-21)

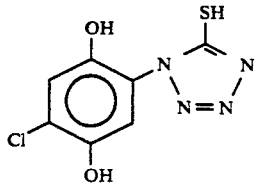

I-22)

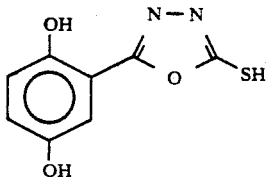

I-23)

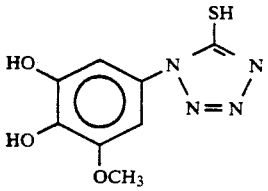

The synthesis methods for making the compounds of formula (I) are explained below with reference to a typical synthetic example.

SYNTHETIC EXAMPLE: COMPOUND (I-11)

Into a reaction vessel equipped with a stirrer and a tube introducing a nitrogen gas were charged 23.8 g (0.1 mole) of 5-phenylbenzotriazolecarbonate, 25.2 g (0.11 mole) of 2-(4-aminophenyl)ethylhydroquinone and 100 ml of DMAC and were stirred for 5 hours while heating in an oil bath of 120° C. (an external temperature) and flowing nitrogen. After completing the reaction, DMAC was distilled off under reduced pressure and 200 ml of methanol was added to deposit a small amount of a byproduct of black crystals as an insoluble matter. This insoluble matter was filtered off by a vacuum filtration. The reaction mixture obtained by distilling off methanol under reduced pressure was separated and refined with a silica gel column (chloroform/methanol 4/1), followed by washing with methanol, whereby 14.4 g of the objective Compound (I-11) was obtained (yield: 38.5%). Melting point: 256 to 257° C.

The compound represented by formula (I) is added in an amount of preferably $1\times10^{-5}$ to $1\times10^{-1}$ mole per mole of silver halide, more preferably $1\times10^{-4}$ to $5\times10^{-2}$ mole per mole of silver halide.

Preferable examples of the layers in which the compound represented by formula (I) is added include an emulsion layer and a layer adjacent to an emulsion layer. The most preferable layer is an emulsion layer.

In the photographic material of the present invention, a hydrazine derivative may be used. The hydrazine derivatives used in the present invention are preferably the compounds represented by the following formula (II):

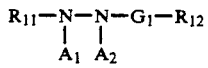

(II)

wherein $R_{11}$ represents an aliphatic group or an aromatic group; $R_{12}$ represents a hydrogen atom, an alkyl group, an aryl group, an alkoxy group, an aryloxy group, an amino group, or a hydrazino group; $G_1$ represents

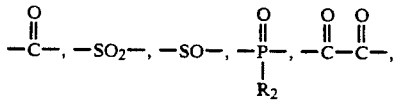

a thiocarbonyl group, or an iminomethylene group; and $A_1$ and $A_2$ represent a hydrogen atom or one of them represents a hydrogen atom and the other represents a substituted or unsubstituted alkylsulfonyl group (preferably 1 to 20 carbon atoms), a substituted or unsubstituted arylsulfonyl group (preferably 6 to 20 carbon atoms), or a substituted or unsubstituted acyl group (preferably 1 to 20 carbon atoms).

In formula (II), the aliphatic group represented by $R_{11}$ is a group having 1 to 30 carbon atoms, particularly a linear or branched cyclic alkyl group having 1 to 20 carbon atoms. This alkyl group may have a substituent.

The aromatic group represented by $R_{11}$ in formula (II) is a monocyclic or dicyclic aryl group or a unsaturated heterocyclic group, provided that the unsaturated heterocyclic group may be condensed with the aryl group.

A preferred group for $R_{11}$ is an aryl group, and particularly preferred is an aryl group containing a benzene ring.

The aliphatic or aromatic group represented by $R_{11}$ may be substituted. The examples of typical substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric amide group, a diacylamino group, an imide group, and a

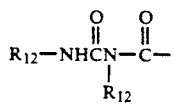

group. Among them, the preferable substituents are an alkyl group (having preferably 1 to 20 carbon atoms), an aralkyl group (having preferably 7 to 30 carbon atoms), an alkoxy group (having preferably 1 to 20 carbon atoms), a substituted amino group (preferably being substituted by an alkyl group having 1 to 20 carbon atoms), an acylamino group (having preferably 2 to 30 carbon atoms), a sulfonamide group (having preferably 1 to 30 carbon atoms), a ureido group (having preferably 1 to 30 carbon atoms), and a phosphoric amide group (having preferably 1 to 30 carbon atoms).

In formula (II), the alkyl group represented by $R_{12}$ is preferably an alkyl group having 1 to 4 carbon atoms, and the aryl group represented by $R_{12}$ is preferably a monocyclic or dicyclic aryl group (e.g. an aryl group containing a benzene group).

When $G_1$ is a $$-\overset{\overset{\displaystyle O}{\|}}{C}-$$

group, the groups represented by $R_{12}$, are preferably a hydrogen atom, an alkyl group (e.g., methyl, trifluoromethyl, 3-hydroxypropyl, 3-methanesulfonamidepropyl, and phenylsulfonylmethyl), an aralkyl group (e.g., o-hydroxybenzyl group), and an aryl group (e.g., phenyl, 3,5-dichlorophenyl, o-methanesulfonamidephenyl, 4-methanesulfonylphenyl, and 2-hydroxymethylphenyl). Of them, a hydrogen atom is particularly preferred.

$R_{12}$ may be substituted and the substituents to $R_{11}$ defined above can be used as the substituents to $R_{12}$.

$G_1$ in Formula (II) is most preferably a $$-\overset{\overset{\displaystyle O}{\|}}{C}-$$

group.

Further, $R_{12}$ may be a group capable of splitting off the $G_1$-$R_{12}$ portion from the residue of the compound to cause a cyclization reaction to form a cyclic structure containing the atoms of the $G_1$-$R_{12}$ portion. The examples thereof are described in JP-A-63-29751 (the term "JP-A" as used herein means an unexamined published Japanese patent application).

$A_1$ and $A_2$ are most preferably both hydrogen atoms.

$R_{11}$ and $R_{12}$ in Formula (II) may contain therein a ballast group or a polymer which is usually contained in a immobile photographic additive such as a coupler. The ballast group has 8 or more carbon atoms and is relatively inactive to photographic characteristics. It can be selected from an alkyl group, an alkoxy group, a phenyl group, an alyklphenyl group, a phenoxy group, and an alkylphenoxy group. Examples of the polymer are described in JP-A-1-100530.

$R_{11}$ and $R_{12}$ in Formula (II) may contain therein a group strengthening an adsorption to the surface of silver halide grains. Examples of such an adsorption groups include a thiourea group, a heterocyclic thioamide group, a heterocyclic mercapto group, and a triazole group, each of which is described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244 and JP-A-63-234246, and Japanese Patent Applications No. 62-67501.

Examples of the compound represented by formula (II) are shown below but they are not limited thereto.

II-1

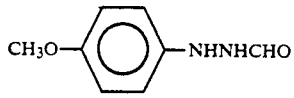

II-2

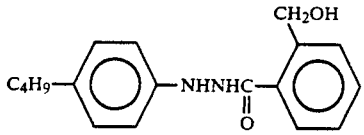

II-3

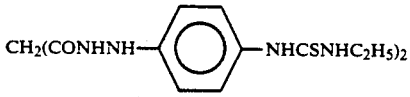

II-4

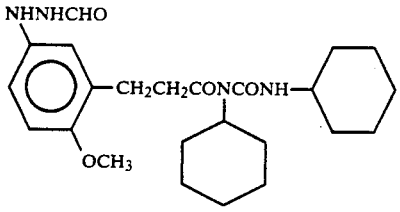

II-5

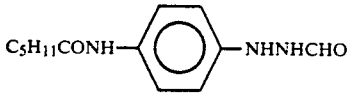

-continued
II-6
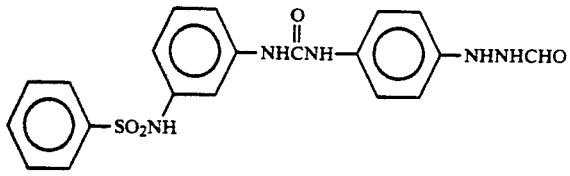
II-7
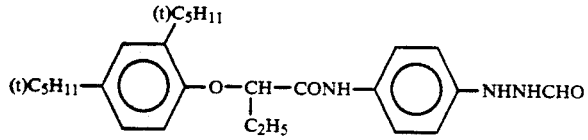
II-8
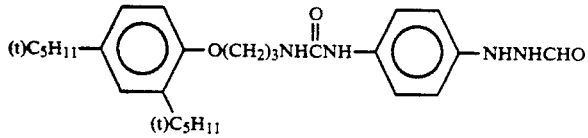
II-9
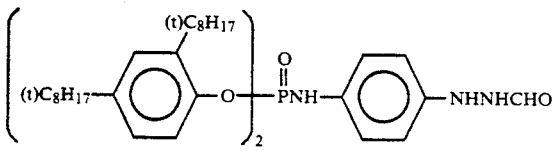
II-10
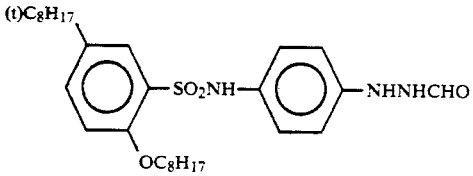
II-11
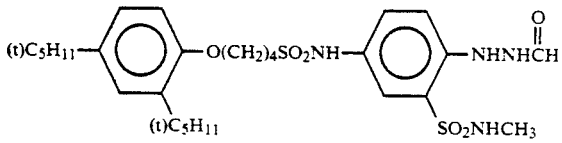
II-12
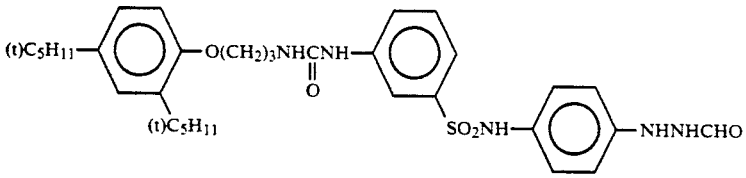
II-13
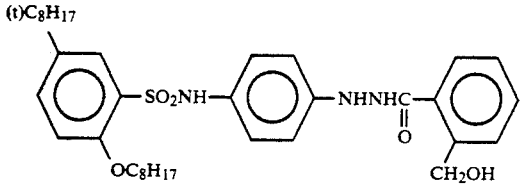
II-14
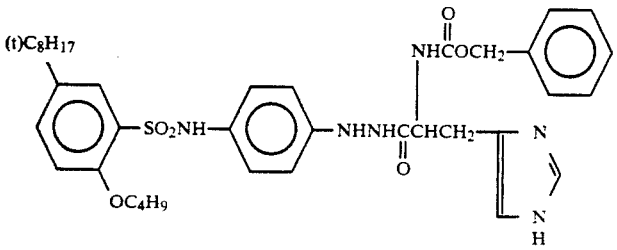

-continued
II-15
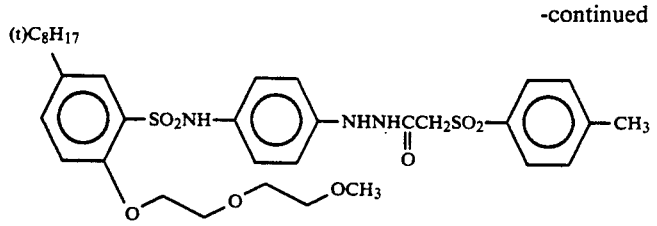
II-16
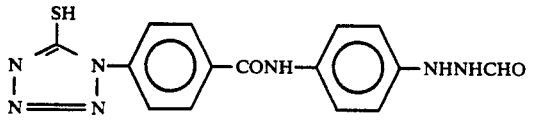
II-17
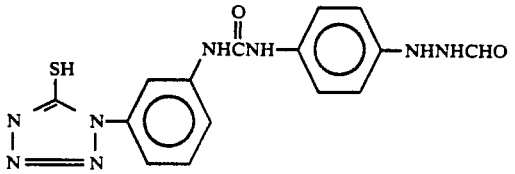
II-18
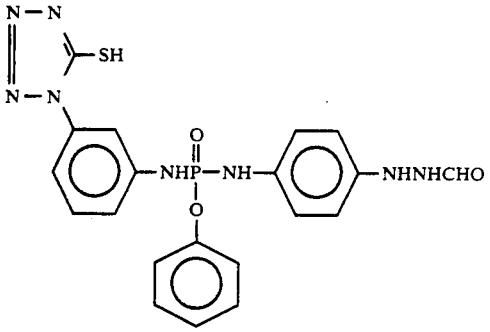
II-19
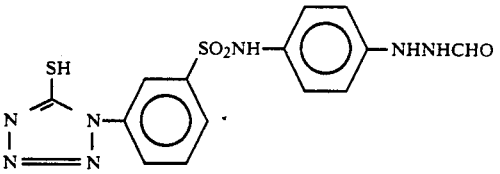
II-20
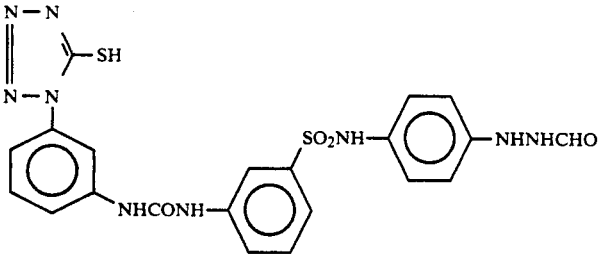
II-21
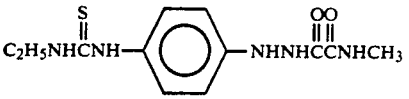
II-22
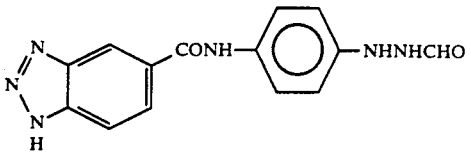

-continued

II-23

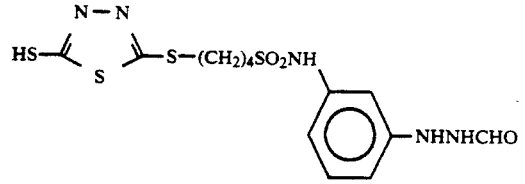

II-24

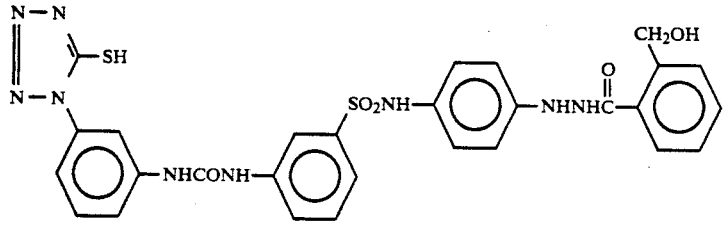

II-25

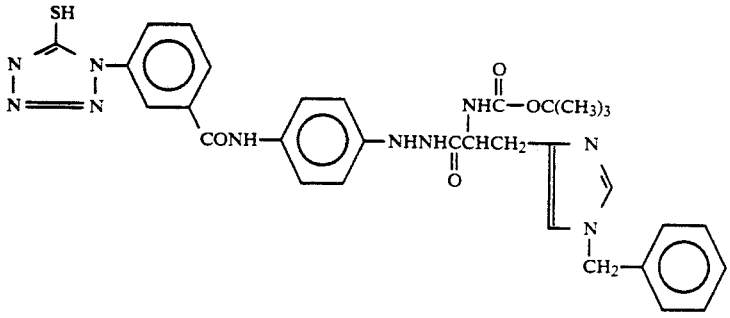

II-26

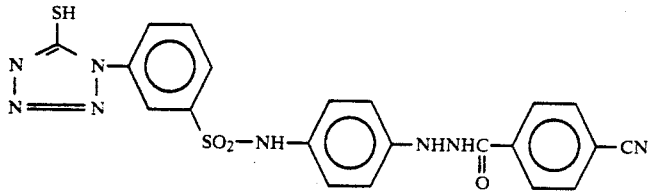

In addition to the above compounds, the examples of the hydrazine derivatives used in the present invention include the compounds described in Research Disclosure, Item 23516 (November, 1983, p. 346) and the documents cited therein, U.S. Pat. Nos. 4,080,207, 4,269,929, 4,276,364, 4,278,748, 4,385,108, 4,459,347, 4,560,638, and 4,478,928; British Patent 2,011,391B; JP-A-60-179734, JP-A-62-270948, JP-A-63-29751, JP-A-61-170733, JP-A-61-270744, and JP-A-62-948, EP217,310; U.S. Pat. No. 4,686,167; JP-A-62 178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-1-283549, JP-A-1-285940, JP-A-2-2541, JP-A-2-77057, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750 and JP-A-2-304550 and Japanese Patent Application No. 63-179760.

In the present invention, the addition amount of the hydrazine derivative is preferably $1\times10^{-6}$ to $5\times10^{-2}$ per mole of silver halide, and in particular the range of $1\times10^{-5}$ to $2\times10^{-2}$ mole per mole of silver halide is a preferable addition amount.

Preferable examples of the layers in which the compound represented by formula (II) is added include an emulsion layer and a layer adjacent to an emulsion layer. The most preferable layer is an emulsion layer.

When the compounds of formulas (I) and (II) are incorporated into the photographic materials, the compound can be added in silver halide emulsion solution or a hydrophilic colloid solution in the form of an aqueous solution in which the compound is dissolved (when the compound is water-soluble) or in the form of a solution of a water-micible organic solvent such as alcohols (e.g. methanol and ethanol), esters (e.g. ethyl acetate) and ketones (e.g. acetone), in which the compound is dissolved (when the compound is water-insoluble).

The addition can be carried out at any time from the initiation of chemical ripening to the coating, preferably after the completion of chemical ripening. In particular, they are added preferably to a coating solution just before coating.

The photographic emulsions used in the invention can be prepared by the methods described in *Chimie et Physique Photographique*, by P. Glafkides (published by Paul Montel Co., 1967), *Photographic Emulsion Chemistry*, by G.F. Duffin (published by The Focal Press, 1966), and *Making and Coating Photographic Emulsion*, by V.L. Zelikman et al (published by The Focal Press, 1964); a conversion method described in U.S. Pat. Nos. 2,592,250 and 4,075,020; and a core/shell emulsion preparation method described in British Patent 1,027,146.

The way to react a water-soluble silver salt (an aqueous silver nitrate solution) and water-soluble halide may be any one of a single-jet mixing method, a double-jet mixing method and the combination thereof. A method in which pAg in a silver halide emulsion is kept constant during the preparation of the silver halide, i.e., a controlled double-jet method, can be used as a modification of the double-jet method.

Further, a so-called silver halide solvent such as ammonia, thioether and a four-substituted thiourea can be used in forming the silver halide grains.

The controlled double-jet method and the grain-forming method using the silver halide solvent make it easy to form silver halide grains having regular crystal forms and narrower grain size distributions.

The silver halide contained in a photographic emulsion can have a relatively broad grain size distribution but it has preferably a narrow grain size distribution. In particular, 90% of the total grains in terms of a weight or number fall preferably within the range of ±40% of an average grain size (in general, such an emulsion is called a monodispersed emulsion).

The silver halide grains contained in a photographic emulsion may have a regular crystal form such as a cube or an octahedron, an irregular crystal form such as a sphere or a plate, or a composite form of these crystal forms.

The inside and surface of the silver halide grains may comprise a uniform layer or different ones.

Two or more kinds of the silver halide emulsions which are prepared separately may be used as a mixture.

There may coexist in the silver halide emulsion used in the present invention, a cadmium salt, sulfite, a lead salt, a thallium salt, an iridium salt or a complex salt thereof, and a rhodium salt or a complex salt thereof in the course of the formation or physical ripening of the silver halide grains.

The silver halide emulsions used in the invention may or may not be chemically sensitized. One example of a chemical sensitizing method is gold sensitization and further, sulfur sensitization, reduction sensitization and noble metal sensitization can be used in combination with the gold sensitization.

Among the noble metal sensitizations, the gold sensitization method is the typical one, wherein a gold compound, mainly a gold complex, is used. There may be contained the complexes of noble metals other than gold, such as platinium, palladium and iridium. Examples thereof are described in U.S. Pat. No. 2,448,060 and British Patent 618,061.

In addition to the sulfur compounds contained in gelatin, various sulfur compounds such as thiosulfates, thioureas, thiazoles and rhodanines can be used as a sulfur sensitizer. The examples thereof are described in U.S. Pat. Nos. 1,574,944, 2,278,947, 2,410,689, 2,278,668, 3,501,313, and 3,656,955.

Stannous compounds, amines, formamidine sulfinic acids and silane compounds can be used as a reduction sensitizer. The examples thereof are described in U.S. Pat. Nos. 2,487,850, 2,518,698, 2,983,609, 2,983,610, and 2,694,637.

Further, the silver halide emulsions can be spectrally sensitized for the purpose of increasing a sensitivity thereof and sensitizing them in a desired wavelength range. In the spectral sensitization, the sensitizing dyes such as a cyanine dye and a merocyanine dye are used singly or in combination thereof to provide a spectral sensitization and a supersensitization.

These techniques are described in U.S. Pat. Nos. 2,688,545, 2,912,329, 3,397,060, 3,615,635, and 3,628,964; JP-B-43-4936 (the term "JP-B" as used herein means examined Japanese patent publication) and JP-B-44-14030; and JP-A-55-52050.

The photographic emulsions used in the present invention can contain various compounds in addition to the above compounds for the purposes of preventing fog in preparing, storing and photographically processing the light-sensitive materials and stabilizing the photographic properties. Examples thereof include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptoterazole); mercaptopyrimidines; mercaptotriazines; thioketo compounds such as oxazolinethions; azaindenes such as triazaindenes, tetrazaindenes [in particular, 4-hydroxy substituted (1,3,3a,7)tetrazaindenes], and pentazaindenes; and many compounds which are known as antifoggants and stabilizers, such as benzenethiosulfonic acid, benzenesulfinic acid, and benzenesulfonic amide.

Among them, particularly preferred are benzotriazoles (e.g. 5-methylbenzotriazoles) and nitroindazoles (e.g. 5-nitroindazoles). Further, these compounds may be contained in the processing solutions.

The photographic emulsion layers and other hydrophilic colloid layers of the photographic materials of the invention may contain an inorganic or organic hardener. Examples thereof include chromium salts (e.g. chrome alum and chromium acetate), aldehydes (e.g. formaldehyde, glyoxal and glutaric aldehyde), N-methylol compounds (e.g. dimethylolurea and methyloldimethylhydantoin), dioxane derivatives (e.g. 2,3-dihydroxydioxane), active vinyl compounds (e.g. 1,3,5-triacryloyl-hexahydro-s-trazine and 1,3-vinylsulfonyl-2-propanol), active halogen compounds (e.g. 2,4-dichloro-6-hydroxy-s-trazine), and mucohalogen acids (e.g. mucochloric acid and mucophenoxychloric acid. They may be used singly or in combination thereof.

The photographic emulsion layers and other hydrophilic colloid layers of the light-sensitive materials prepared according to the present invention may contain various surfactants for various purposes such as coating aid, prevention of electrification, improvement in sliding, emulsification-dispersion, prevention of sticking, and improvement in the photographic characteristics (e.g. acceleration of development, harder gradation and sensitization).

Examples thereof include nonionic surfactants such as saponin (steroid type), alkylene oxide derivatives (e.g. polyethylene glycol, a polyethylene glycol/polypropyrene glycol condensation product, polyethylene glycol alkyl ethers, polyethylene glycol alkyl aryl ethers, polyethylene glycol esters, polyethylene glycol sorbitan esters, polyethylene glycol alkylamines or amides, and adducts of silicon and polyethylene oxide), glycidol derivatives (e.g. alkenylsuccinic acid polyglycerides and alkylphenol polyglycerides), fatty acid esters of polyhydric alcohols, and alkylesters of sucrose; anionic surfactants having acid groups such as a carboxy group, a sulfo group, a phospho group, a sulfate group and a phosphate group, such as alkylcarbonic acid salts, alkylsulfonic acid salts, alkylbezenesulfonic acid salts, alkylnaphthalenesulfonic acid salts, alkyl sulfates, alkyl phosphates, N-acyl-N-alkyltaurines, sulfosuccinates, sulfoalkyl polyoxyethylenealkylphenyl ethers, and polyoxyethylenealkyl phosphates; amphoteric surfactants such as amino acids, aminoalkylsulfonic acids, aminoalkyl sulfates, aminoalkyl phosphates, alkylbetains, and amine oxides; and cationic surfactants such as alkylamine salts, aliphatic or aromatic quaternary ammonium salt, heterocyclic quaternary ammonium salts such as imidazoniums and pyridiniums, and aliphatic or heterocycle-containing phosphonium or sulfonium compounds.

The surfactants especially preferably used in the present invention are polyalkylene oxides having a molecular weight of 600 or more described in JP-B-58-9412.

The photographic materials of the present invention can contain a dispersion of water-insoluble or hardly water-soluble synthetic polymers in the photographic emulsion layers and other hydrophilic colloid layers for the purpose of improving a dimensional stability. Examples thereof include homopolymers or copolymers of alkyl methacrylate, alkoxyalkyl methacrylate, glycidyl methacrylate, methacrylamide, vinyl ester (e.g. vinyl acetate), acrylonitrile, olefines, styrene, and the combinations thereof; and copolymers of the above monomers and the monomer composition comprising the combination of acrylic acid, methacrylic acid, $\alpha$, $\beta$-unsaturated dicarboxylic acid, hydroxylalkyl methacrylate, sulfoalkyl methacrylate, and styrenesulfonic acid.

It is preferable to use a dihydroxybenzene developing agent as a primary developing agent and to use a p-aminophenol developing agent or a 3-pyrazolidone developing agent as an auxiliary developing agent.

Examples of the dihydroxybenzene developing agent used in the invention include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone. Of them, hydroquinone is particularly preferred.

Examples of 1-phenyl-3-pyrazolidone and the derivatives thereof as the auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of the p-aminophenol auxiliary developing include N-methyl-p-aminophenol, p-aminophenol, N-($\beta$-hydroxyethyl)-p-aminophenol, N-(4-hydroxyphenyl) glycine, 2-methyl-p-aminophenol, and p-benzyl aminophenol. Among them, N-methyl-p-aminophenol is preferred.

The dihydroxybenzene developing agent is used usually in an amount of 0.05 to 0.8 mol/liter. Where the combination of dihydroxybenzenes and 1-phenyl-3-pyrazolidones or p-aminophenols is used, the former is used preferably in an amount of 0.05 to 0.5 mol/liter and the latter in an amount of 0.06 mol/liter or less.

Examples of the sulfite preservative used in the present invention include sodium sulfite, potassium sulfite, lithium sulfite, sodium bisulfite, potassium metabisulfite, and formaldehyde sodium bisulfite. The sulfite is used in an amount of 0.3 mol/liter or more. An excessive addition thereof will cause the deposition to contaminate a processing solution, and therefore the upper limit is preferably 1.2 mol/liter.

The developing solution used in the invention can contain a quaternary amine compound, in particular the compounds described in U.S. Pat. No. 4,269,929, as a development accelerator.

In the developing solution used in the invention, there can be used pH buffer agents such as boric acid, borax, tertiary sodium phosphate and tertiary potassium phosphate. In addition thereto, the pH buffer agents described in JP-A-60-93433 can be used.

The developing solution used in the invention may contain a development inhibitor such as potassium bromide and potassium iodide; an organic solvent such as ethylene glycol, diethylene glycol, triethylene glycol, dimethylformamide, methylcellosolve, hexylene glycol, ethanol, and methanol; and an antifoggant or black pepper inhibitor such as indazole compounds including 5-nitroindazole and benzotriazoles including 2-mercaptobenzimidazole-5-sulfonate and 5-methylbenzotriazole. Especially when compounds such as 5-nitroindazole are used, the solution thereof is usually prepared separately from the solution containing the dihydroxybenzene developing agent and sulfite preservative, and both solutions are mixed just before using. Further, the alkalinization of the solution containing 5-nitroindazole makes it convenient to handle the solution since it colors yellow.

Further, the developing solution may contain a color-toning agent, a surfactant, a softening agent and a hardener, if necessary.

In the present invention, the organic sulfur compounds of which function as a fixing agents can be used in addition to thiosulfates and thiocyanates.

A fixing solution may contain a water-soluble aluminium salt as a hardener. The examples thereof are aluminium sulfate, aluminium ammonium sulfate, aluminium potassium sulfate and aluminum chloride. Among them, aluminium sulfate is preferable.

The aluminium salts are used in an amount of 0 to 0.01 mol/liter, more preferably 0 to 0.005 mol/liter. The pH value of the fixing solution is preferably 5.3 or higher, more preferably 5.5 to 7.0.

An amount of sulfite in the fixing solution is preferably 0.05 to 1.0 mol/liter, more preferably 0.07 to 0.8 mol/liter.

The fixing solution used in the invention can contain various acids, salts, a chelating agent, a surfactant, a humidifier, and a fixing accelerator.

Examples of the acids include inorganic acids such as sulfuric acid, hydrochloric acid, nitric acid and boric acid and organic acids such as formic acid, propionic acid, oxalic acid and phthalic acid.

The examples of the salts are lithium, potassium, sodium and ammonium salts of these acids.

The examples of the chelating agent are amino polycarboxylic acids such as nitrilo triacetate and ethylenediaminetetracetic acid.

The examples of the surfactant are an anionic surfactant such as sulfated compounds and sulfonated compounds; nonionic surfactants such as polyethylene glycols and esters; and amphoteric surfactants described in JP-A-57-6840 (the title of the invention: a photographic fixing solution).

The examples of the humidifier are alkanolamines and alkylene glycols.

The examples of the fixing accelerator are thiourea derivatives and alcohols having triple bonds in molecules described in JP-B-45-35754 and JP-A-58-122535 and JP-A-58-122536; and thioethers described in U.S. Pat. No. 4,126,459.

Among the above additives, the acids and salts such as boric acid and amino polycarboxylic acid are preferred since they promote the effects of the present invention. The fixing solution containing boric acid or salt thereof is more preferred. The addition amount of boric acid or salt thereof is preferably 0.5 to 20 g/liter, more preferably 4 to 15 g/liter.

In the rapid processing performed according to the present invention, the emulsion layers and/or other hydrophilic colloid layers contain preferably organic substances flowing out in the step of development processing. Where the flowing-out substance is gelatin, it is preferably gelatin which is insusceptible to a cross-linking reaction with a hardener. Examples thereof include acetylated gelatin and phthalized gelatin. Gelatin having a lower molecular weight is preferable. Polymers other than the gelatin effectively used in the invention are hydrophilic polymers such as polyacrylamide described in U.S. Pat. No. 3,271,158, polyvinylalcohol and polyvinylpyrrolidone, and sugars such as dextrane, sucrose and plurane are effective as well. Of them, polyacrylamide and dextrane are preferable and polyacrylamide is particularly preferable. The average molecular weight of these substances is preferably 20,000 or less, more preferably 10,000 or less. In addition to the above, there can be used the antifoggants and stabilizers described in *Research Disclosure* Vol. 176, No. 17643, Item VI (December, 1978).

The development processing method of the present invention can be applied to a photographic plate-making light-sensitive material containing a tetrazolium salt as described in JP-A-52-18317, JP-A-53-95618, JP-A-58-173737, and JP-A-58-106493.

Further, a developing solution used herein contains preferably the amino compounds described in U.S. Pat. No. 4,269,929 as hard gradation accelerators.

In the present invention, the total processing time (dry to dry time) means the time between the point at which the leading end of the photographic material enters into hte developer and the point at which it comes out from the final drying zone.

Examples of the present invention are shown below but the invention is not limited thereto.

EXAMPLE 1

Preparation of the Emulsion

To a solution containing 5 g of potassium bromide, 0.05 g of potassium iodide, 30 g of gelatin, 2.5 ml of a 5% aqueous solution of thioether $HO(CH_2)_2S(CH_2)_2S(CH_2)_2OH$ in one liter of water were added an aqueous solution containing 8.33 g of silver nitrate and an aqueous solution containing 5.94 g of potassium bromide and 0.726 g of potassium iodide by a double-jet method for 45 seconds, while maintaining the temperature of the solution at 73° C. Subsequently, after adding 2.5 g of potassium bromide, an aqueous solution containing 8.33 g of silver nitrate was added in such a speed that the flow amount at the completion of addition was twice as large as that at the initiation of addition. Then, 20 ml of a 25% ammonium solution and 10 ml of a 50% $NH_4NO_3$ solution were added to carry out a physical ripening for 20 minutes and 240 ml of 1N sulfuric acid was added to neutralize, followed by adding a solution containing 153.34 g of silver nitrate and a potassium bromide solution by a controlled double-jet method for 40 minutes while maintaining a potential at pAg 8.2. The flow speed was accelerated so that the flow amount at the completion of addition was nine times as large as that at the initiation of addition. After the completion of addition, 15 ml of a 2N potassium thiocyanate solution and further, 25 ml of a 1% potassium iodide solution were added for 30 seconds. Then, the temperature was lowered to 35° C. and the water-soluble salts were removed by a settling method. The temperature was raised to 40° C. and 30 g of gelatin and 2 g of phenol were added, followed by adding caustic soda and potassium bromide to adjust pH and pAg to 6.4 and 8.10, respectively.

The temperature was raised to 56° C. and 600 mg of a sensitizing dye and 150 mg of a stabilizer each having the following chemical structure were added. After 10 minutes, 2.4 mg of sodium thiosulfate 5 hydrate, 140 mg of potassium thiocyanate and 2.1 mg of chloroauric acid were added to the emulsion, which was rapidly cooled down 80 minutes later and solidified to obtain the emulsion. The emulsion thus obtained comprised grains having an aspect ratio of 3 or more, which corresponded to 98% of the sum of a projected area of the total grains. The grains having an aspect ratio of 2 or more have an average projected area-corresponding circle diameter of 1.4 μm, a standard deviation of 15%, an average thickness of 0.187 μm and the aspect ratio of 7.5.

Sensitizing Dye:

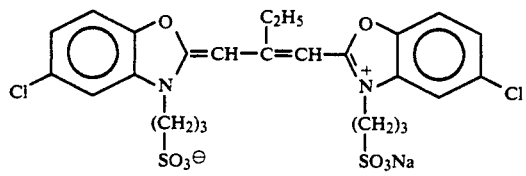

Stabilizer:

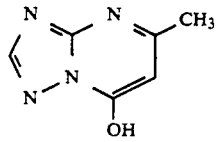

Preparation of an Emulsion Coating Solution

The following compounds were added to the emulsion to prepare an emulsion coating solution:

| | |
|---|---|
| Gelatin: | |
| gelatin was added so that a ratio of Ag/binder became 1.0 (binder: gelatin + polymer) | |
| Water = soluble polyester: | 15.0 g |
| WD-Size manufactured by Eastman Chemical Co. | |
| Polymer latex: | 25.0 g |
| copolymer of ethyl acrylate and methacrylate (97:3) | |
| Hardener: | |
| 1,2-bis(sulfonylacetoamide) ethane: the amount was adjusted to a swelling value shown in Table 1 | |
| 2,6-bis(hydroxyamino)-4-diethylamino-1,3,5-triazine | 80 mg |
| Poly-sodium acrylate: | 4.0 g |
| an average molecular weight: 41,000 | |
| Poly-potassium styrenesulfonate: | 1.0 g |
| an average molecular weight: 600,000 | |

The coating solution of the above composition and a surface protective layer-coating solution were coated simultaneously on a transparent PET support of a 175 μm thickness so that the silver coated amount was as shown in Table 1, whereby Samples No. 1 to 38 were prepared as shown in Table 1.

The composition of the surface protective layer-coating solution was prepared and coated so that the coated amounts of the respective components was as shown below.

| Component | Coated amount |
|---|---|
| Gelatin | Adjusted to the amounts shown in Table 1 |
| Polyacrylamide an average molecular weight: 45,000 | 0.1 g/m$^2$ |
| Poly-sodium acrylate an average molecular weight: 400,000 | 0.02 |
| Sodium p-t-octylphenoxydiglycelyl-butylsulfonate | 0.02 |
| Polyoxyethylene cetyl ether a polymerization degree: 10 | 0.035 |
| Polyoxyethylene (polymerization degree: 10)/polyoxyglycelyl-p-octylphenoxy ether (polymerization degree: 3) | 0.01 |
| $C_8F_{17}SO_3K$ | 0.003 |
| $C_8F_{17}SO_2N(C_3H_7)(CH_2)_4(CH_2)_4SO_3Na$ | 0.001 |
| $C_8F_{17}SO_2N(C_3H_7)(CH_2CH_2O)_{10}(CH_2CHCH_2O)_4H$ | 0.003 |
| Polymethylmethacrylate an average grain size: 3.5 μm | 0.025 |
| Copolymer of methyl methacrylate and methacrylate (molar ratio: 7:3; an average grain size: 2.5 μm) | 0.020 |
| Composition of a fixing solution | |
| Ammonium thiosulfate | 200 g |
| Sodium sulfite | 17 g |
| Boric acid | 7 g |
| Sodium acetate 3 hydride | 24 g |
| Sodium citrate 2 hydride | 2 g |

Water, aluminium sulfate and acetic acid were added to make the total quantity one liter so that the Al amount and the pH value were as shown in Table 1.

The sulfite ion concentration of this fixing solution was 0.13 mole/liter.

Each of Sample Nos. 1 to 38 was exposed to a green light having a peak in 550 nm for 1/20 second, and then they were subjected to an SP processing (45 seconds on a dry to dry basis) with an automatic processing machine FPM 9000 using a developing solution RD 7 each manufactured by Fuji Photo Film Co., Ltd. and the above fixing solution at 35° C.

The above processed samples were subjected to the following evaluations.

Sensitivity

Sensitivity is defined by the reciprocal of an exposure giving a density of fog+1.0 and expressed by a value relative to that of Sample No. 1, which was set at 100.

Fixer Removal

Fogs of the samples which were subjected to a development processing without exposure were visually observed.

The evaluation grade "A" was given to the samples (A4 size) in which any portion was totally transparent; the grade "B" was given to those in which an inferior fixer removal was observed in some portions of the perimeters thereof; the grade "C" was given to those in which an inferior fixer removal was observed in the central area as well as in the perimeters; and the grade "D" was given to those in which an inferior fixer removal was observed in the overall portions. Practicability is given up to the grade "B".

Drying Characteristic

Twenty sheets of a sample of a A4 size were subjected to a continuous processing and the 21st sheet just after coming out of an automatic processing machine was observed by touching with a hand to evaluate the drying characteristic.

The evaluation grade "A" was given to the samples which were dried and till warm; the grade "B" was given to the samples which were dried but not warm; the grade "C" was given to the samples on which a little moisture still remained; and the grade "D" was given to the samples which were entirely wet. Practicability was given up to the grade "B".

The drying temperature of the automatic processor was set at 50° C., and the environment of the room in which the processor was put was controlled to 25° C. and 60% RH.

Smell

The fixing solutions heated to 37° C. were sniffed by nose and the grade "A" was given to the solutions having little unpleasant smell of acetic acid and sulfur dioxide gas; the grade "B" was given to those having only a little smell to such an extent as not feeling unpleasant; the grade "C" was given to those having an unpleasant smell to a pretty large extent; and the grade "D" was given to those having an unpleasant smell to an intolerable extent. Practicability is given up to the grade "B".

The results of the above evaluations are shown in Table 1.

TABLE 1

| Sample No. | Coated silver amnt*1 | Swelling thickness μ | Ratio of A/B*2 | Coated gelatin amnt*3 | Al in fixing sltn*4 | pH in fixing sltn | Sensitivity | Fixer removal | Drying characteristic | Smell of fixer |
|---|---|---|---|---|---|---|---|---|---|---|
| 1 (Comp.) | 3.7 | 3.7 | 1.0 | 0.7 | — | 4.1 | 100 | B | B | D |
| 2 (Comp.) | 3.7 | 3.7 | 1.0 | 0.7 | — | 4.8 | 100 | B | B | C |
| 3 (Inv.) | 3.7 | 3.7 | 1.0 | 0.7 | — | 5.5 | 100 | A | A | B |
| 4 (Inv.) | 3.7 | 3.7 | 1.0 | 0.7 | — | 6.2 | 100 | A | A | A |
| 5 (Inv.) | 3.7 | 3.7 | 1.0 | 0.7 | — | 7.0 | 100 | A | A | A |
| 6 (Inv.) | 3.7 | 3.7 | 1.0 | 0.7 | — | 8.0 | 100 | A | B | B |
| 7 (Comp.) | 3.7 | 4.6 | 0.8 | 0.7 | — | 4.8 | 102 | A | C | C |
| 8 (Comp.) | 3.7 | 4.6 | 0.8 | 1.3 | — | 4.8 | 100 | C | D | C |
| 9 (Comp.) | 3.7 | 3.1 | 1.2 | 0.7 | — | 4.8 | 100 | B | B | C |
| 10 (Comp.) | 3.7 | 3.1 | 1.2 | 1.3 | — | 4.8 | 98 | D | C | C |
| 11 (Inv.) | 3.7 | 9.3 | 0.4 | 0.5 | — | 5.5 | 105 | A | B | B |
| 12 (Inv.) | 3.7 | 4.6 | 0.8 | 0.5 | — | 5.5 | 102 | A | A | B |
| 13 (Inv.) | 3.7 | 3.1 | 1.2 | 0.5 | — | 5.5 | 102 | A | A | B |

TABLE 1-continued

| Sample No. | Coated silver amnt*1 | Swelling thickness μ | Ratio of A/B*2 | Coated gelatin amnt*3 | Al in fixing sltn*4 | pH in fixing sltn | Sensitivity | Fixer removal | Drying characteristic | Smell of fixer |
|---|---|---|---|---|---|---|---|---|---|---|
| 14 (Inv.) | 3.7 | 2.2 | 1.7 | 0.5 | — | 5.5 | 100 | B | A | B |
| 15 (Inv.) | 3.7 | 9.3 | 0.4 | 0.8 | — | 5.5 | 102 | A | B | B |
| 16 (Inv.) | 3.7 | 4.6 | 0.8 | 0.8 | — | 5.5 | 100 | A | A | B |
| 17 (Inv.) | 3.7 | 3.1 | 1.2 | 0.8 | — | 5.5 | 100 | A | A | B |
| 18 (Inv.) | 3.7 | 2.2 | 1.7 | 0.8 | — | 5.5 | 98 | B | A | B |
| 19 (Comp.) | 3.7 | 9.3 | 0.4 | 1.3 | — | 5.5 | 100 | B | C | B |
| 20 (Comp.) | 3.7 | 4.6 | 0.8 | 1.3 | — | 5.5 | 98 | C | B | B |
| 21 (Comp.) | 3.7 | 3.1 | 1.2 | 1.3 | — | 5.5 | 95 | D | A | B |
| 22 (Comp.) | 3.7 | 2.2 | 1.7 | 1.3 | — | 5.5 | 93 | D | A | B |
| 23 (Inv.) | 3.7 | 9.3 | 0.4 | 0.8 | — | 6.2 | 102 | A | B | A |
| 24 (Inv.) | 3.7 | 4.6 | 0.8 | 0.8 | — | 6.2 | 100 | A | A | A |
| 25 (Inv.) | 3.7 | 3.1 | 1.2 | 0.8 | — | 6.2 | 100 | A | A | A |
| 26 (Inv.) | 3.7 | 2.2 | 1.7 | 0.8 | — | 6.2 | 98 | B | A | A |
| 27 (Inv.) | 3.0 | 3.8 | 0.8 | 0.7 | — | 6.2 | 100 | A | A | A |
| 28 (Comp.) | 3.0 | 3.8 | 0.8 | 1.3 | — | 6.2 | 95 | C | B | A |
| 29 (Inv.) | 3.0 | 2.5 | 1.2 | 0.7 | — | 6.2 | 98 | B | A | A |
| 30 (Comp.) | 3.0 | 2.5 | 1.2 | 1.3 | — | 6.2 | 93 | C | B | A |
| 31 (Inv.) | 3.7 | 4.6 | 0.8 | 0.7 | 0.005 | 5.5 | 102 | A | A | B |
| 32 (Comp.) | 3.7 | 4.6 | 0.8 | 1.3 | 0.005 | 5.5 | 100 | C | B | B |
| 33 (Inv.) | 3.7 | 3.1 | 1.2 | 0.7 | 0.005 | 5.5 | 100 | B | A | B |
| 34 (Comp.) | 3.7 | 3.1 | 1.2 | 1.3 | 0.005 | 5.5 | 98 | D | B | B |
| 35 (Comp.) | 3.7 | 4.6 | 0.8 | 0.7 | 0.02 | 5.5 | 102 | C | A | B |
| 36 (Comp.) | 3.7 | 4.6 | 0.8 | 1.3 | 0.02 | 5.5 | 100 | D | A | B |
| 37 (Comp.) | 3.7 | 3.1 | 1.2 | 0.7 | 0.02 | 5.5 | 100 | D | A | B |
| 38 (Comp.) | 3.7 | 3.1 | 1.2 | 1.3 | 0.02 | 5.5 | 98 | D | A | B |

Note:
*1 $g/m^2$
*2 A: Coated silver amount, B: swelling thickness
*3 Coated gelatin amount, $g/m^2$, in a protective layer
*4 mole/liter As shown in Table 1, it can be found that the samples of the invention are excellent in fixer removal, drying characteristic and smell.

The less the gelatin amount in the protective layer and the Al amount in the fixing solution, the better the fixer removal is. Further, it is found that the less the ratio of the coated silver amount to the swelling thickness, the better the fixer removal is, and that a higher pH of the fixing solution is more advantageous.

The less the gelatin amount in the protective layer and the higher the ratio of the coated silver amount to the swelling thickness, the better the fixer removal is. It is found that the ratio of the coated silver amount to the swelling thickness has a preferable range.

The higher the pH, the better the smell of the fixing solution tends to be.

EXAMPLE 2

A silver nitrate aqueous solution corresponding to 5% of the whole solution and a mixed aqueous solution of potassium bromide and potassium iodide were added to a vessel containing 5 g of potassium bromide and 30 g of gelatin in 1 liter of water while maintaining pAg at 9.5. Subsequently, an additional 5% of the silver nitrate solution was added by a single-jet method and further, the remaining 90% of the silver nitrate solution and the mixed aqueous solution of potassium bromide and potassium iodide were added by the double-jet method while keeping pAg at 8.1. There was prepared an emulsion comprising the tabular silver bromoiodide grains having an average projected area-corresponding circle diameter of 1.3 μm, a standard deviation of 15% and an aspect ratio of 6.5. This emulsion was subjected to chemical sensitization with sodium thiosulfate and chloroauric acid to thereby obtain a light-sensitive silver bromoiodide emulsion containing iodide of 3 mol% and having a pAg of 8.6 and a pH of 6.4.

Preparation of the Coated Samples

The following components were coated on the back side of a triacetylcellulose support provided in advance with a subbing layer:

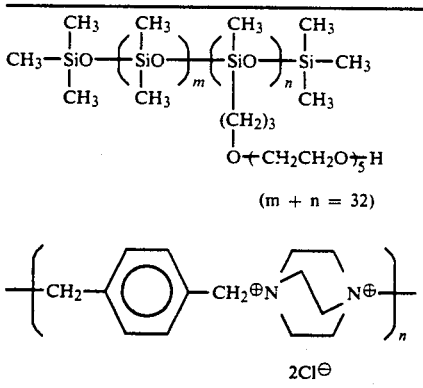

(m + n = 32)

10 $mg/m^2$

60 $mg/m^2$

| | |
|---|---|
| Diacetylcellulose | 143 $mg/m^2$ |
| Silicate | 5 $mg/m^2$ |

Next, the following components were coated on the emulsion-coating side of the support.

| Emulsion layer | |
|---|---|
| Coated AgX amount as converted to silver | 3.5 $g/m^2$ |
| Gelatin | 0.5 g/g Ag |
| 4-Hydroxy-6-methyl-1,3,3a,7-tetrazaindene | 10 mg/g Ag |
| Polyethylene oxide | 8 mg/g Ag |
| Poly-potassium p-vinylbenzene sulfonate | 20 mg/g Ag |
| Sensitizing dye | 230 mg/mol Ag |

-continued

Emulsion layer

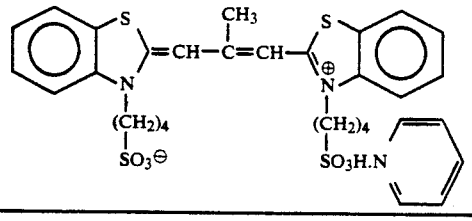

The compounds of formula (I) were added in the amounts as shown in Table 2.

Hardening was adjusted with an addition amount of bis-(vinylsulfonylacetoamide) ethane so that the swelling thicknesses were the values shown in Table 2, wherein the swelling thickness was obtained by deducting the dry thickness of a coated sample from the wet thickness thereof measured just after the sample which was stored at 25° C. and 65% RH for 7 days was dipped in distilled water at 25° C. for 30 seconds.

Further, a surface protective layer of the following composition was coated on the silver halide emulsion layer, whereby Samples Nos. 39 to 67 were prepared.

| Surface protective layer | |
|---|---|
| Gelatin amount | adjusted to the amounts as shown in Table 2 |
| Poly-potassium p-vinylbenzenesulfonate | 1 mg/m$^2$ |
| Polymethyl methacrylate fine particles (an average size: 3μ) | 0.13 mg/m$^2$ |
| Composition of a developing solution | |
| Sodium sulfite | 67 g |
| Hydroquinone | 23 g |
| 1-Phenyl-3-pyrazolidone | 0.4 g |
| Potassium hydroxide | 11 g |
| Potassium bromide | 3.0 g |
| Sodium carbonate 1 hydride | 11 g |
| 5-methyl-benzotriazole | 0.2 g |
| Following compound | 288 mg |

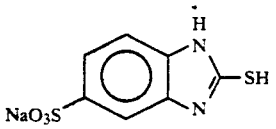

| | |
|---|---|
| Water was added to make the total quantity one liter. | pH: 10.65 |
| Composition of a fixing solution | |
| Sodium thiosulfate 5 hydride | 45 g |
| Disodium ethylenediaminetetracetate | 0.5 g |
| Ammonium thiosulfate | 150 g |
| Sodium sulfite anhydrous | 12 g |
| Potassium acetate | 16 g |
| Citric acid | 1 g |
| Boric acid | 7 g |

Water, sulfuric acid and aluminium hydroxide were added to make the total quantity one liter. Sulfuric acid was added so that the pH had the values shown in Table 2. Similarly, aluminium hydroxide was added so that the concentrations shown in Table 2 were obtained.

The above samples were stored at 25° C. and 65% RH for 7 days and exposed to a light which was adjusted to have a wavelength distribution corresponding to a sun light with a filter for 1/100 second. The exposed samples were subjected to a development processing with an automatic processor FG-710 NH manufactured by Fiji Photo Film Co., Ltd. using the above developing and fixing solutions at 38° C. for 45 seconds on a dry to dry base. The drying temperature was set at 50° C.

The processed samples were subjected to the following evaluations.

Sensitivity

Sensitivity is defined by the reciprocal of the exposure giving a density of fog+0.3 and expressed by a value relative to that of Sample No. 39, which was set at 100.

Scuff Sensitization (Pressure Fog)

There was visually observed a scuff sensitization in a foot portion of a characteristic curve (sensitometry), in which a little background density was found.

The load on a needle (of which the point was in the form of a sphere having a diameter of 25 μm) for scratching was increased while moving the needle and the load was recorded in which the scuff sensitization started appearing. The larger this value is, the higher the anti-scuff property is. The load is preferably 6 g or more.

Other Characteristics

The fixer removal, drying characteristic and smell characteristic were evaluated in the same manner as in Example 1.

The results of the above evaluations are shown in Table 2.

TABLE 2

| Sample No. | Swelling thickness μ | Ratio of A/B*1 | Coated gelatin amnt*2 | Compound of Formula (I) Type | Compound of Formula (I) Ad. amnt*3 | Al in fixing sltn*4 | pH in fixing sltn | Sensitivity | Fixer removal | Drying characteristic | Smell of fixer | Scuff (g) |
|---|---|---|---|---|---|---|---|---|---|---|---|---|
| 39 (Comp.) | 3.5 | 1.0 | 0.7 | — | — | — | 4.3 | 100 | C | B | D | 7 |
| 40 (Comp.) | 3.5 | 1.0 | 0.7 | — | — | — | 4.9 | 100 | B | B | C | 7 |
| 41 (Inv.) | 3.5 | 1.0 | 0.7 | — | — | — | 5.5 | 100 | A | A | A | 7 |
| 42 (Inv.) | 3.5 | 1.0 | 0.7 | — | — | — | 6.0 | 100 | A | A | A | 8 |
| 43 (Inv.) | 3.5 | 1.0 | 0.7 | — | — | — | 6.5 | 100 | A | A | A | 8 |
| 44 (Inv.) | 3.5 | 1.0 | 0.5 | — | — | — | 6.0 | 105 | A | A | A | 6 |
| 45 (Inv.) | 3.5 | 1.0 | 0.8 | — | — | — | 6.0 | 100 | A | B | A | 8 |
| 46 (Comp.) | 3.5 | 1.0 | 1.3 | — | — | — | 6.0 | 98 | C | C | A | 9 |
| 47 (Inv.) | 4.4 | 0.8 | 0.5 | I-1 | 0.5 | — | 6.0 | 105 | A | A | A | 9 |
| 48 (Inv.) | 4.4 | 0.8 | 0.8 | I-1 | 0.5 | — | 6.0 | 102 | B | A | A | 10 |
| 49 (Comp.) | 4.4 | 0.8 | 1.3 | I-1 | 0.5 | — | 6.0 | 95 | C | B | A | 10≦ |
| 50 (Inv.) | 4.4 | 0.8 | 0.5 | I-9 | 0.3 | — | 6.0 | 100 | A | A | A | 10 |
| 51 (Inv.) | 4.4 | 0.8 | 0.8 | I-9 | 0.3 | — | 6.0 | 98 | A | A | A | 10≦ |
| 52 (Comp.) | 4.4 | 0.8 | 1.3 | I-9 | 0.3 | — | 6.0 | 95 | C | B | A | 10≦ |
| 53 (Inv.) | 4.4 | 0.8 | 0.5 | I-1 | 0.5 | 0.005 | 6.0 | 105 | A | A | A | 9 |

TABLE 2-continued

| Sample No. | Swelling thickness μ | Ratio of A/B*1 | Coated gelatin amnt*2 | Compound of Formula (I) Type | Compound of Formula (I) Ad. amnt*3 | Al in fixing sltn*4 | pH in fixing sltn | Sensitivity | Fixer removal | Drying characteristic | Smell of fixer | Scuff (g) |
|---|---|---|---|---|---|---|---|---|---|---|---|---|
| 54 (Inv.) | 4.4 | 0.8 | 0.8 | I-1 | 0.5 | 0.005 | 6.0 | 102 | A | A | A | 10 |
| 55 (Comp.) | 4.4 | 0.8 | 1.3 | I-1 | 0.5 | 0.005 | 6.0 | 95 | C | B | A | 10≦ |
| 56 (Comp.) | 4.4 | 0.8 | 0.5 | I-1 | 0.5 | 0.02 | 6.0 | 105 | C | B | A | 9 |
| 57 (Comp.) | 4.4 | 0.8 | 0.8 | I-1 | 0.5 | 0.02 | 6.0 | 102 | C | C | A | 10 |
| 58 (Comp.) | 4.4 | 0.8 | 1.3 | I-1 | 0.5 | 0.02 | 6.0 | 95 | D | C | A | 10≦ |
| 59 (Inv.) | 2.1 | 1.7 | 0.5 | — | — | — | 6.0 | 100 | B | A | A | 7 |
| 60 (Inv.) | 2.1 | 1.7 | 0.8 | — | — | — | 6.0 | 98 | B | A | A | 8 |
| 61 (Comp.) | 2.1 | 1.7 | 1.3 | — | — | — | 6.0 | 95 | D | B | A | 8 |
| 62 (Inv.) | 7.0 | 0.5 | 0.5 | — | — | — | 6.0 | 102 | A | A | A | 8 |
| 63 (Inv.) | 7.0 | 0.5 | 0.8 | — | — | — | 6.0 | 100 | A | B | A | 8 |
| 64 (Comp.) | 7.0 | 0.5 | 1.3 | — | — | — | 6.0 | 98 | B | D | A | 9 |
| 65 (Comp.) | 3.5 | 1.0 | 0.5 | — | — | 0.02 | 6.0 | 100 | C | A | A | 5 |
| 66 (Comp.) | 3.5 | 1.0 | 0.8 | — | — | 0.02 | 6.0 | 98 | D | B | A | 7 |
| 67 (Comp.) | 3.5 | 1.0 | 1.3 | — | — | 0.02 | 6.0 | 95 | D | C | A | 8 |

Note:
*1A: Coated silver amount, B: swelling thickness
*2Coated gelatin amount, g/m², in a protective layer
*3g/mol of Ag
*4mole/liter As shown by the results summarized in Table 2, it is found that the samples of the invention are excellent with respect to fixer removal, drying characteristic and smell of the fixing solution.

The use of the compounds of formula (I) can further improve the scuff (i.e., pressure fog). It is found that the value of the coated silver amount to the swelling thickness falling within the range of 0.6 to 1.5 further improves the fixer removal and drying characteristic.

EXAMPLE 3

A silver nitrate aqueous solution and a solution of potassium bromide and potassium iodide were mixed by a double-jet method in the presence of ammonium while keeping the pAg at 7.9 to thereby prepare a monodispersed silver bromoiodide emulsion (silver bromide: 98.0 mol%, silver iodide: 2.0 mol%) comprising a cubic grains having an average grain size of 0.2 μm.

This silver bromoiodide emulsion was subjected to chemical sensitization by adding sodium thiosulfate of $3\times10^{-5}$ mol/mol of Ag for sulfur sensitization.

There was added thereto the sensitizing dye, sodium

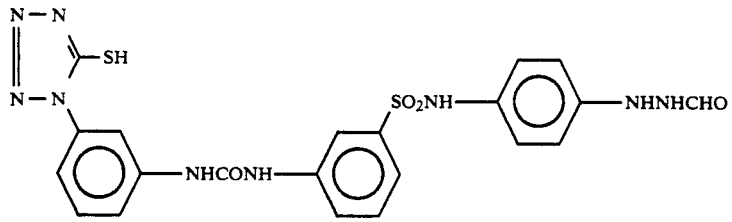

5,5'-dichloro-3,3'-di(3-sulfopropyl)-9-ethyloxacarbocyanine, of $6\times10^{-4}$ per mole of Ag to provide spectral sensitization.

Further, there was added 4-hydroxy-6-methyl-1,3,3a,7-tertazaindene as a stabilizer; the following compound and saponin as a coating aid:

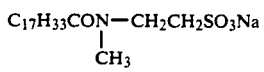

the following compound as a vinylsulfon type hardener so that a swelling thickness was as in shown in Table 3;

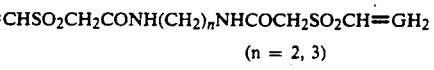

poly-sodium styrenesulfonate as a thickener; and a dispersion of polyethyl acrylate of 0.30 g/m² and the following compound of 0.40 g/m² as a polymer latex:

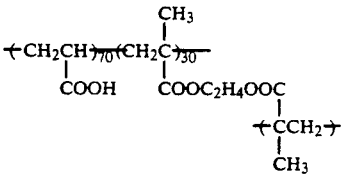

Further, there was added hydroquinone of 1 g and 1-phenylmercaptotetrazole of 0.1 g, each per 1 mole of Ag, and then the following compound of $6.0\times10^{-4}$ mole/mole of Ag was added as a hydrazine compound:

In addition, the compound of formula (I) was added in the amount as shown in Table 3.

The emulsion layer and a protective layer were simultaneously coated so that the coated silver amount was 3.6 g/m² and the coated gelatin amount of the protective layer was a value shown in Table 3, wherein the protective layer comprised gelatin, sodium dodecylbenzenesulfonate, a silicon oil, a fluorine type surfactant, a colloidal silica, a dispersion of polyethyl acrylate, a matting agent of polymethyl methacrylate (a grain size: 2.5 μm) and a thickener of poly-sodium styrenesulfonate, whereby Sample Nos. 68 to 84 were prepared.

Each two sheets of these samples were prepared; one was subjected to a pressure sensitization test (scuff sensitization test) by scratching with a sapphire needle of 0.025 mϕ loaded with 2, 4, 6, 8 and 10 g; and the other, which was not scratched, was for evaluating the sensitivity.

These two sheets were exposed to a tungsten light of 3200° K. for 5 seconds through an optical wedge for a sensitometry and then were processed with the developing and fixing solutions of the following compositions at 38° C. for 45 seconds on a dry to dry base. The development processing was carried out with an automatic processor SRX-501 manufactured by Konica Corp., wherein the drying temperature was set at 50° C.

| Composition of the developing solution | |
|---|---|
| Hydroquinone | 50.0 g |
| N-methyl-p-aminophenol disulfate | 0.3 |
| Sodium hydroxide | 18.0 |
| 5-Sulfosalycylic acid | 45.0 |
| Potassium sulfite | 110.0 |
| Disodium ethylenediamine tetracetate | 1.0 |
| Potassium bromide | 10.0 |
| 5-Methylbenzotriazole | 0.4 |
| 2-Mercaptobenzoimidazole-5-sulfonic acid | 0.3 |
| Sodium 3-(5-mercaptotetrazole)-benzenesulfonate | 0.2 |
| N-n-butyl diethanolamine | 15.0 |
| Sodium toluenesulfonate | 8.0 |
| Water added to make the total quantity | 1 l |

The pH was adjusted to 11.6 with potassium hydroxide.

| Composition of the fixing solution | |
|---|---|
| Ammonium thiosulfate | 150 g |
| Sodium sulfite | 30 |
| Boric acid | 7 |
| Sodium acetate 3 hydride | 7 |
| $(CH_3)_2N-(CH_2)_2SH.HCl$ | 1 |

Sulfuric acid and aluminium sulfate were added so that the pH value and the aluminium salt concentration had the values shown in Table 3, and the total quantity was adjusted to 1 liter by adding water.

The processed samples were subjected to the following evaluations:

Sensitivity

Sensitivity was defined by the reciprocal of the exposure to give a density of fog plus 1.5 in the characteristic curve and was expressed by the value relative to that of Sample No. 68, which was set at 100.

Scuff

Scuff was evaluated in the same manner as in Example 2.

Fixer Removal, Drying Characteristic and Smell

The above items were evaluated in the same manner as in Example 1.

The results of the above evaluations are shown in Table 3.

TABLE 3

| Sample No. | Swelling thickness μ | Ratio of A/B*1 | Coated gelatin amnt*2 | Compound of Formula (I) Type | Compound of Formula (I) Ad. amnt*3 | Al in fixing sltn*4 | pH in fixing sltn | Sensitivity | Fixer removal | Drying characteristic | Smell of fixer | Scuff (g) |
|---|---|---|---|---|---|---|---|---|---|---|---|---|
| 68 (Comp.) | 4.0 | 0.9 | 0.7 | — | — | — | 4.2 | 100 | B | A | D | 8 |
| 69 (Comp.) | 4.0 | 0.9 | 0.7 | — | — | — | 4.8 | 100 | B | A | C | 8 |
| 70 (Inv.) | 4.0 | 0.9 | 0.7 | — | — | — | 5.5 | 100 | A | A | B | 8 |
| 71 (Inv.) | 4.0 | 0.9 | 0.7 | — | — | — | 6.2 | 102 | A | A | A | 8 |
| 72 (Inv.) | 4.0 | 0.9 | 0.7 | — | — | — | 7.0 | 102 | A | B | A | 8 |
| 73 (Inv.) | 4.0 | 0.9 | 0.4 | — | — | — | 6.2 | 105 | A | A | A | 7 |
| 74 (Inv.) | 4.0 | 0.9 | 0.8 | — | — | — | 6.2 | 102 | A | A | A | 8 |
| 75 (Comp.) | 4.0 | 0.9 | 1.2 | — | — | — | 6.2 | 98 | C | B | A | 8 |
| 76 (Inv.) | 4.0 | 0.9 | 0.4 | I-9 | 0.5 | — | 6.2 | 100 | A | A | A | 10 |
| 77 (Inv.) | 4.0 | 0.9 | 0.8 | I-9 | 0.5 | — | 6.2 | 100 | A | A | A | 10≦ |
| 78 (Comp.) | 4.0 | 0.9 | 1.2 | I-9 | 0.5 | — | 6.2 | 98 | C | B | A | 10≦ |
| 79 (Comp.) | 4.0 | 0.9 | 0.4 | I-9 | 0.5 | 0.02 | 6.2 | 100 | C | A | A | 10 |
| 80 (Comp.) | 4.0 | 0.9 | 0.8 | I-9 | 0.5 | 0.02 | 6.2 | 100 | D | A | A | 10≦ |
| 81 (Comp.) | 4.0 | 0.9 | 1.2 | I-9 | 0.5 | 0.02 | 6.2 | 98 | D | B | A | 10≦ |
| 82 (Inv.) | 2.8 | 1.3 | 0.4 | I-9 | 0.5 | — | 6.2 | 98 | A | A | A | 7 |
| 83 (Inv.) | 2.8 | 1.3 | 0.8 | I-9 | 0.5 | — | 6.2 | 98 | B | A | A | 8 |
| 84 (Comp.) | 2.8 | 1.3 | 1.2 | I-9 | 0.5 | — | 6.2 | 95 | D | B | A | 8 |

Note:
*1A: a coated silver amount B: a swelling thickness
*2Coated gelatin amount, g/m², in a protective layer.
*3Addition amount, g/mol of Ag.
*4mole/liter.

As shown by the results summarized in Table 3, it is found that the samples of the invention are excellent in their fixing characteristic, their drying characteristic and the smelling of the fixing solution. The samples processed with the processing solutions containing the compounds of formula (I) were further improved in the scuff.

While the invention has been described in detail and with reference to specific embodiments thereof, it will be apparent to one skilled in the art that various changes and modifications can be made therein without departing from the spirit and scope thereof.

I claim:

1. A method for processing an image-wise exposed silver halide photographic material comprising a support and having provided thereon at least one silver halide light-sensitive layer in a total processing time of 20 to 60 seconds with an automatic processor, wherein said processor has a fixing solution which has:

(a) a pH of 5.3 or more, (b) a sulfite ion concentration of 0.05 to 1.0 mole/-liter, and (c) an aluminum compound content of 0 to 0.01 mole/liter; and wherein a protective layer is provided on the side of the silver halide emulsion layers on the photographic material and contains gelatin in an amount of 1.0 g/m$^2$ or less;

wherein the ratio of the coated silver amount (g/m$^2$) to the swelling thickness (μm) in the silver halide photographic material is 0.6 to 1.5.

2. The method for processing a silver halide photographic material of claim 1, wherein the silver halide photographic material contains a compound of the following Formula (I):

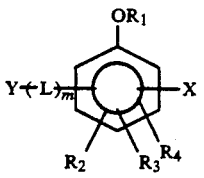

wherein X represents $OR_1$ or

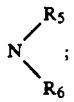

$R_1$ represents a hydrogen atom or a group capable of becoming a hydrogen atom by hydrolysis; $R_2$, $R_3$ and $R_4$ each represent a hydrogen atom or a substituent; $R_5$ and $R_6$ each represent a hydrogen atom, an alkyl group, an aryl group, an alkylsulfonyl group, an arylsulfonyl group, an alkylcarbonyl group, an arylcarbonyl group, or a carbamoyl group; Y represents a group promoting absorption to silver halide; L represents a divalent linkage group; and m is 0 or 1.

3. The method for processing a silver halide photographic material of claim 1, wherein the coated amount of the gelatin in the protective layer is 0.2 to 0.8 g/m$^2$.

4. The method for processing a silver halide photographic material of claim 1, wherein the coated amount of the gelatin in the protective layer is 0.3 to 0.7 g/m$^2$.

5. The method for processing a silver halide photographic material of claim 1, wherein the amount of coated silver is 2.0 to 4.0 g/m$^2$.

6. The method for processing a silver halide photographic material of claim 1, wherein the swelling thickness if 1.5 to 6.5 microns.

7. The method for processing a silver halide photographic material of claim 1, wherein the ratio of the coated silver amount and the swelling thickness in the silver halide photographic material is 0.7 to 1.3.

8. The method for processing a silver halide photographic material of claim 1, wherein the material contains a compound represented by the following formula (II):

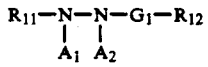

wherein $R_{11}$ represents an aliphatic group or an aromatic group: $R_{12}$ represents a hydrogen atom, an alkyl group, an aryl group, an alkoxy group, an aryloxy group, an amino group, or a hydrazino group; $G_1$ represents

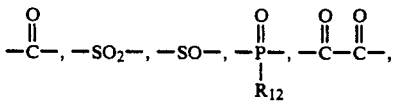

a thiocarbonyl group, or an iminomethylene group; and $A_1$ and $A_2$ represent a hydrogen atom or one of them represents a hydrogen atom and the other represents a substituted or unsubstituted alkylsulfonyl group, a substituted or unsubstituted arylsulfonyl group, a substituted or unsubstituted acyl group.

9. The method for processing a silver halide photographic material of claim 1, wherein the fixing solution has an aluminium compound content of 0 to 0.005 mol/liter.

* * * * *